US007301453B2

(12) United States Patent
Fry

(10) Patent No.: US 7,301,453 B2
(45) Date of Patent: Nov. 27, 2007

(54) LOCATOR SYSTEM AND METHOD

(76) Inventor: Terry L. Fry, 7257 Parkway Dr., Suite 102, Hanover, MD (US) 21076

( * ) Notice: Subject to any disclaimer, the term of this patent is extended or adjusted under 35 U.S.C. 154(b) by 105 days.

(21) Appl. No.: 11/086,333

(22) Filed: Mar. 23, 2005

(65) Prior Publication Data

US 2005/0212672 A1 Sep. 29, 2005

Related U.S. Application Data

(60) Provisional application No. 60/555,301, filed on Mar. 23, 2004.

(51) Int. Cl.
*G08B 1/08* (2006.01)

(52) U.S. Cl. ..... 340/539.13; 342/132; 342/146; 702/150; 702/151

(58) Field of Classification Search ..... 340/539.1, 340/539.11, 539.19, 539.21, 539.32; 342/132, 342/146; 702/150, 151
See application file for complete search history.

(56) References Cited

U.S. PATENT DOCUMENTS 4,101,873 A 7/1978 Anderson et al.
4,151,525 A 4/1979 Strauch et al.
4,320,397 A * 3/1982 Frosch et al. ..... 342/82
4,476,469 A 10/1984 Lander
4,673,921 A 6/1987 Saito et al.
5,631,641 A 5/1997 Howe
5,677,673 A 10/1997 Kipnis
5,680,105 A 10/1997 Hedrick
5,689,238 A 11/1997 Cannon, Jr. et al.
5,714,932 A 2/1998 Castellon et al.
5,786,758 A 7/1998 Bullock
5,939,981 A 8/1999 Renney
6,075,442 A * 6/2000 Welch ..... 340/573.1
6,203,262 B1 * 3/2001 Frich et al. ..... 414/331.01
6,344,797 B1 2/2002 Hosny
6,462,658 B1 10/2002 Bender
6,486,777 B2 * 11/2002 Clark ..... 340/539.1
6,501,378 B1 12/2002 Knaven
6,539,393 B1 3/2003 Kabala
6,545,606 B2 4/2003 Piri et al.
6,611,232 B1 8/2003 Wunderlich et al.
6,630,892 B1 10/2003 Crockford et al.
6,634,959 B2 10/2003 Kuesters
6,643,516 B1 11/2003 Stewart
7,084,769 B2 * 8/2006 Bauer et al. ..... 340/572.7
2001/0029724 A1 * 10/2001 DeMatteis ..... 53/459

(Continued)

*Primary Examiner*—Jeffery Hofsass
*Assistant Examiner*—Edny Labbees
(74) *Attorney, Agent, or Firm*—Jones, Tullar & Cooper, PC

(57) ABSTRACT

A locator system includes two main components, namely, (1) a beacon tag that is readily attached to a person or article, and (2) a transportable finder or receiver/processor for sensing the relative position of the tag and indicating changes in that relative position to a user. The method for locating a person or article preferably uses an audible feedback signal to the user for informing the user, when moving, whether the relative position of the beacon tag is getting closer to the finder or farther from the finder. The locator system includes at least one beacon tag comprising a transmitter programmed to transmit a unique coded pulse signal. The beacon tag is housed in a lightweight portable envelope or container and includes a battery, an antenna, a large programmed gate array and a frequency reference (e.g., a crystal oscillator).

20 Claims, 6 Drawing Sheets

U.S. PATENT DOCUMENTS

2001/0050613 A1* 12/2001 Clark ..... 340/539
2002/0036569 A1* 3/2002 Martin ..... 340/573.1
2003/0218539 A1* 11/2003 Hight ..... 340/539.13
2004/0021572 A1* 2/2004 Schoen et al. ..... 340/572.1
2004/0070535 A1* 4/2004 Olsson et al. ..... 342/459
2006/0103532 A1* 5/2006 Van Fleet ..... 340/572.1
2006/0139172 A1* 6/2006 Waldner et al. ..... 340/572.7

* cited by examiner

LOCATOR SYSTEM AND METHOD

RELATED PATENT AND PENDING PATENT APPLICATION INFORMATION

This application claims priority to provisional patent application No. 60/555,301, filed Mar. 23, 2004, the entire disclosure of which is incorporated herein by reference.

BACKGROUND OF THE INVENTION

1. Field of the Invention

The present invention relates to locator devices and more particularly pertains to a new locator system for locating persons or articles in potentially hazardous situations or environments.

2. Discussion of the Prior Art

Conventional approaches used to locate individuals or articles in hazardous situations are based on simply looking for or listening for the individual or article. These approaches are effective for some "missing first responder" scenarios, but there are occasions when a missing individual or article may go unnoticed. One scenario where this is possible is in a collapsed or burning building. A noisy environment accompanying damage control or rescue operations in bad weather or at night makes it difficult to see or hear a missing person. The problem is compounded when many people are responding and considerable time may pass before one person is recognized as missing.

A variety of locator systems are described in the prior art. The prior art for locating persons or articles includes, for example, U.S. Pat. No. 6,545,606 (rescue beacon), U.S. Pat. No. 6,539,393 (location data logging), U.S. Pat. No. 6,501,378 (item locator), U.S. Pat. No. 6,643,516 (portable telephone locator), U.S. Pat. No. 6,462,658 (illuminated/sound producing object locator), U.S. Pat. No. 6,611,232 (vehicle lock box locator), U.S. Pat. No. 6,630,892 (danger alert system), U.S. Pat. No. 6,634,959 (golf ball locator), U.S. Pat. No. 5,677,673 (article locator with loudspeaker); U.S. Pat. No. 5,939,981 (item locator with audio speaker), U.S. Pat. No. 4,101,873 (locator with audible response) and U.S. Pat. No. 5,680,105 (color coordinated locator with beeper). While the methods and devices disclosed in these patents do fulfill their own narrow objectives, these patents do not disclose an economical, reliable, truly robust and easy to use locator system suitable for use in finding persons or articles in hazardous situations such as a burning or collapsed structure.

A number of other patents have also disclosed systems for person or article location; for example, U.S. Pat. No. 4,151,525 by Strauch et al., describes an analog radio system for locating a given object. The system displays angle and range data regarding the position of an object in a reference frame. This invention suffers from the following limitations: it has a complex design, it is limited to locating aircraft as it is extremely difficult for a person to orient oneself along a displayed particular angular displacement and the displayed range does not carry any particular significance to a person who is trying to locate an item or a person.

U.S. Pat. No. 4,476,469 by Lander, describes an analog apparatus which can assist in locating an object. It comprises a searcher and a locator attached to the object. The locator gives an audible beep when it is positioned by the searcher. This invention is limited to assisting in locating objects within a short range, up to 6 meters range. Hence, it is only suitable for normal domestic and office conditions. It does not display exact direction of the object location apart from the audible bleep which is generated from the locator attached to the object when it is positioned. In addition, it does not give any visual alerting means to assist in locating the object.

U.S. Pat. No. 4,673,921 by Saito et al., describes an apparatus for finding the location of a car within a large area. In this invention the transmitter is attached to the car and the receiver is portable. Search is carried out until maximum level of the signal generated from the transmitter is displayed. This invention suffers from the following drawbacks: the transmitter is always radiating a signal which represents a drain on the apparatus battery, it is complex in design and construction, it needs a central processing units with sophisticated algorithms and it is impractical.

U.S. Pat. No. 5,631,641 by Howe, describes a vehicle locator system which is integrated into the electrical system of a vehicle. This locator is designed specifically for bird hunters. It emits an audible alarm after the elapse of a specified delay time set up by the hunter when leaving the vehicle. This invention is limited in its application. It does not give any visual alerting means to assist in locating the object, it is an integrated part of the vehicle electrical system and not a stand alone device and it is activated whilst the hunter is away from the vehicle, thus representing a constant electrical load drainage on the vehicle battery.

U.S. Pat. No. 5,689,238 by Cannon et al., describes a method of locating objects by attaching electronic tags to these objects. An electronic tag is identifiable by a unique response code. To locate the object, the response code is entered via an interrogator. The interrogator sends a signal that causes the tag to emit a sound. This invention is only operational if the identifying unique response code stored on the electronic tag is not tampered with in any way. Also if this code is inadvertently erased, the locator will be obsolete.

U.S. Pat. No. 5,786,758 by Bullock, describes a vehicle locator system combining a remote transmitting unit and a vehicle mounted receiving unit actuating a light source mounted on the vehicle's exterior to facilitate the location of the vehicle by the searcher in a crowded or dimly lit places. This system is also capable of selectively actuating the vehicle's horn. This invention suffers from the complexity in mechanical structure and the interference with the car exterior. In addition, the partially lowered vehicle window necessary for installing the vehicle's exterior light source represents a security issue for the vehicle. In addition, the light source may accumulate dirt and grit and due to being subjected to the external environmental conditions may malfunction frequently.

U.S. Pat. No. 5,714,932 by Castellon et al. describes a radio frequency security system with direction and distance locator. The radio frequency security system includes a central control unit and a plurality of portable transmitters which are in radio frequency communication with the central control unit. The system can be used to detect if a child or an inanimate object has crossed a specified boundary security region. It can also yield information regarding range and direction. This invention has a complex design as it includes a central control unit containing a central processing unit and its associated memory devices, a directional detection circuit, a threshold detection circuit, a distance measuring circuit, a keypad input device, an antenna system, an identification circuit and several displays.

U.S. Pat. No. 6,344,797, by Hosney, describes a system configured to provide an audio or visual alert to assist in locating an object, animal or person by triggering an audio buzzer, audio message, music or visual flashing display unit when the object, animal or person is located. An alternative embodiment also gives the searcher a facility for finding the direction of the object, animal or person to be located. A third embodiment additionally permits a searched-for person to know the direction of the searcher.

All of these prior art systems have proven inadequate in many hazardous situations, however, and for a number of reasons. A fire's flame, being an ionized moving plasma of sorts, plays havoc with conventional radio transmission when using conventional transmitted signals, and rescuers or emergency personnel, when under great stress, require information that is immediately discernable to permit quick decisions in what may be a life or death situation. These challenges have rendered the prior art systems unsuitable for use in many hazardous situations.

There is a need, therefore, for an economical, reliable, truly robust and easy to use locator system and method suitable for use in finding persons or articles in hazardous situations such as a burning or collapsed structure.

OBJECTS AND SUMMARY OF THE INVENTION

Accordingly, it is a primary object of the present invention to overcome the above mentioned difficulties by providing an economical, reliable, robust and easy to use locator system for finding persons or articles in hazardous situations such as a burning or collapsed structure.

Another object of the present invention is providing an intuitive method for finding persons or articles in hazardous situations such as a burning or collapsed structure.

The aforesaid objects are achieved individually and in combination, and it is not intended that the present invention be construed as requiring two or more of the objects to be combined unless expressly required by the claims attached hereto.

The locator system of the present invention includes two main components, namely, (1) a beacon tag that is readily attached to a person or article, and (2) a transportable finder or receiver/processor for sensing the relative position of the tag and indicating changes in that relative position to a user.

The present invention also includes a method for locating a person or article using a feedback signal to the user for informing the user, when moving, whether the relative position of the beacon tag is getting closer to the finder or farther from the finder. The method of the present invention is conceptually similar to that favorite child's game in which a blindfolded player is told "your getting warmer" when closing on the object of the search, and, conversely, is told "your getting colder" when turning or walking away from the object.

In the illustrative embodiment, the locator system includes at least one beacon tag comprising a transmitter programmed to transmit a unique coded pulse signal. The beacon tag is housed in a lightweight portable envelope or container and includes a battery, an antenna, a large programmed gate array and a frequency reference (e.g., a crystal oscillator). The package is preferably heat resistant and may be encapsulated in liquid bearing gel. The beacon tag optionally includes a "panic button" control input for changing the transmitted signal by changing, for example, the pulse repetition frequency of the transmitted pulse pairs, for enhanced range resolution.

The finder or receiver/processor is housed in a rugged waterproof portable shell preferably including a depending hand grip. At least one lighted display is provided, along with an audio signal transducer driven by an audio signal generator. Preferably, a microprocessor is programmed with instructions stored in a memory and is connected to and controls a receiver adapted to receive signals from an antenna. An array of accelerometers is configured to sense motion of the finder and the accelerometer signals are input to the microprocessor for use in plotting motion, velocity and acceleration in three dimensions. The finder housing also carries its own portable power supply, such as a battery and at least one control key or control input for use in actuating the "training mode."

The finder is programmed to detect the tag's transmitted signal and begins a search while being carried into a search area by a user. As the user moves, the finder accelerometers, sense the movement and provide data to the finder's microprocessor, which is programmed to calculate and plot the user's movements from an arbitrary origin defined as the place where the search began (e.g., a doorway). The finder fine tunes a perceived tag pulse pair ranging interval when the user is standing still, and then can detect a contraction in perceived ranging interval whenever the user moves to bring the finder closer to the tag, thereby sensing a diminishing relative radius change. Conversely, the finder detects an elongation or stretching in the perceived ranging interval whenever the user moves to bring the finder farther away from tag, thereby sensing a growing relative radius change.

The finder uses this relative radius change detection to determine whether (1) the user's search path is bringing the finder closer to the tag (which is attached to a sought-after individual or article), (2) the user's search path is taking the finder farther from the tag, or (3) the user's search path is not appreciably changing the relative radius between the finder and the tag.

The user is provided with an easily interpreted form of audible feedback through finder audio transducer in real time, when moving during a search, because the finder is programmed to generate a first, agreeable audio signal whenever it is determined that the user's search path is bringing the finder closer to the tag (i.e., "you're getting warmer"). Conversely, the finder is programmed to generate a second, more urgent or strident audio signal whenever it is determined that the user's search path is taking the finder farther from the tag (i.e., "you're getting colder").

The finder is also programmed to provide a visual indication on the finder display of the plotted path taken from the origin and the estimated direction of the sought after tag.

The above and still further objects, features and advantages of the present invention will become apparent upon consideration of the following detailed description of a specific embodiment thereof, particularly when taken in conjunction with the accompanying drawings, wherein like reference numerals in the various figures are utilized to designate like components.

DESCRIPTION OF THE PREFERRED EMBODIMENT

Turning now to FIGS. 1-4, locator system 10 of the present invention includes two main components, namely, a beacon tag 12 that is readily attached to a person or article, and a transportable finder or receiver/processor 14 for sensing the relative position of tag 12 and indicating changes in that relative position to a user.

The present invention also includes a method for locating a person or article using a feedback signal to the user for informing the user, when moving with a finder 14 in hand, whether the relative position of beacon tag 12 is getting closer to the finder or farther from the finder. The method of the present invention is conceptually similar to that favorite child's game in which a blindfolded player is told "you're getting warmer" when closing on the object of the search, and, conversely, is told "you're getting colder" when turning or walking away from the object.

Figure 2:
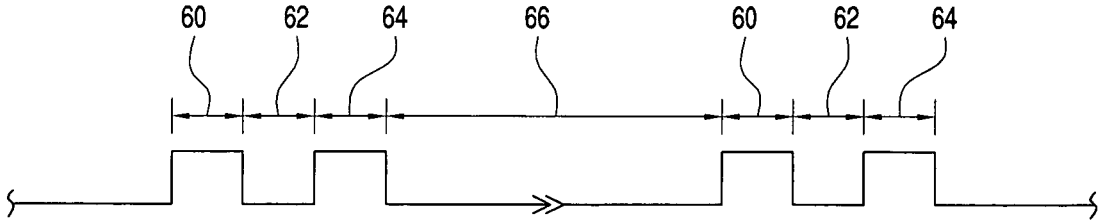
FIG. 2 is a timing diagram illustrating the transmitted pulse signal transmitted from the beacon tag to the finder of the system of FIG. 1, in accordance with the present invention
Figure 4:
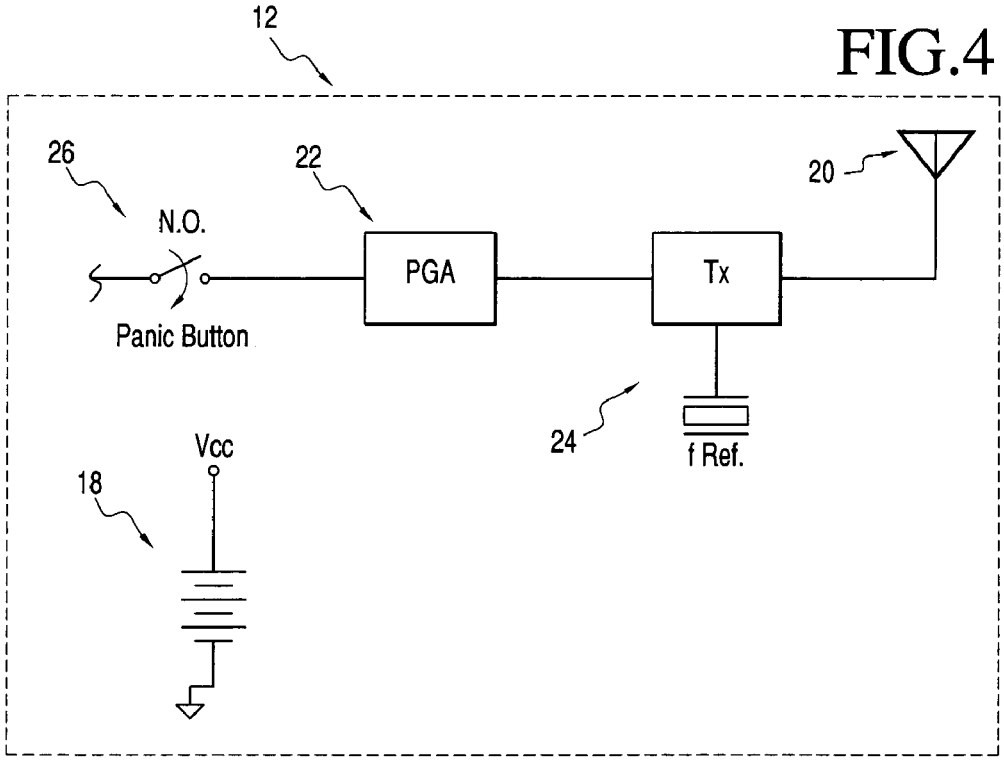
FIG. 4 is a diagram illustrating one embodiment of a beacon tag for use in the locator system of FIGS. 1-3, in accordance with the present invention.

In the illustrative embodiment, locator system 10 includes at least one beacon tag 12 comprising (as best seen in FIG. 4) a transmitter 16 programmed to transmit the unique coded pulse-pair signal (shown in FIG. 2). Beacon tag 12 is housed in a lightweight, preferably flexible, portable envelope or container and includes a battery 18, an antenna 20, a large programmed gate array 22 and a frequency reference 24 (e.g., a crystal oscillator). The package is preferably heat resistant and may be encapsulated in liquid bearing gel. The beacon tag optionally includes a "panic button" 13 actuating a control input 26 for changing the transmitted signal by changing, for example, the pulse repetition frequency of the transmitted pulse pairs, for enhanced range resolution, as will be described below.

Figure 1:
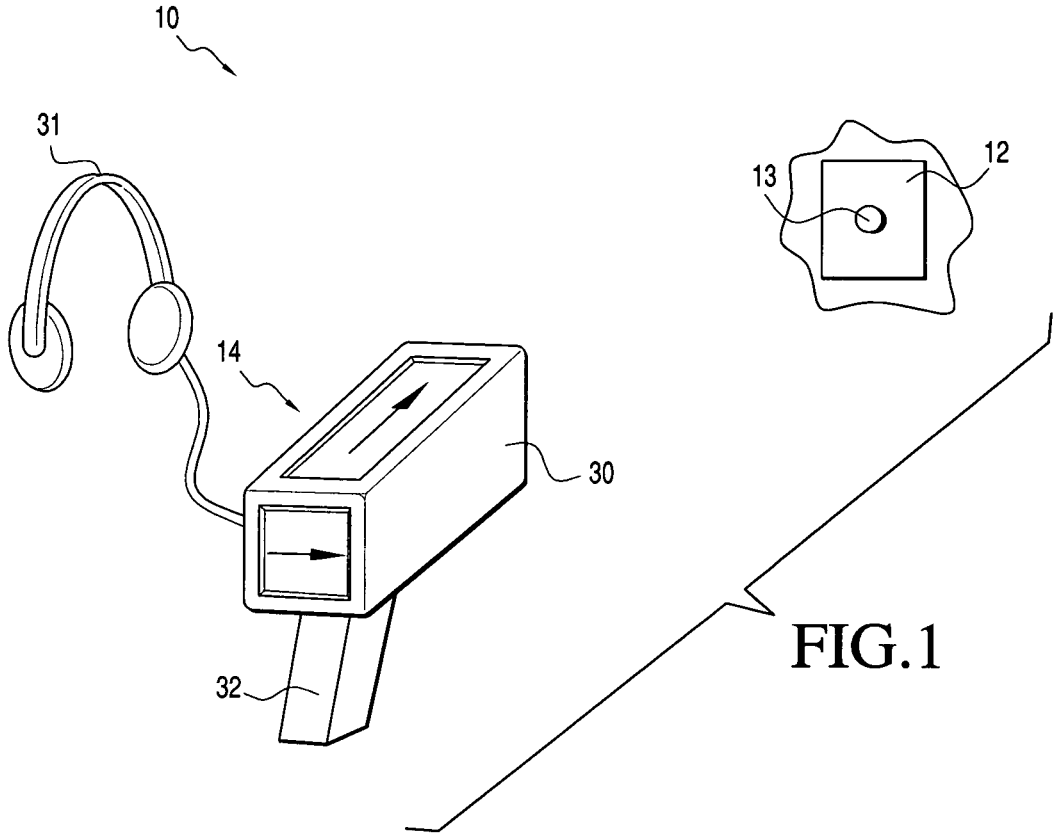
FIG. 1 is a diagram illustrating a locator system including a beacon tag adapted to wirelessly transmit a signal to a portable finder, in accordance with the present invention.
Figure 3:
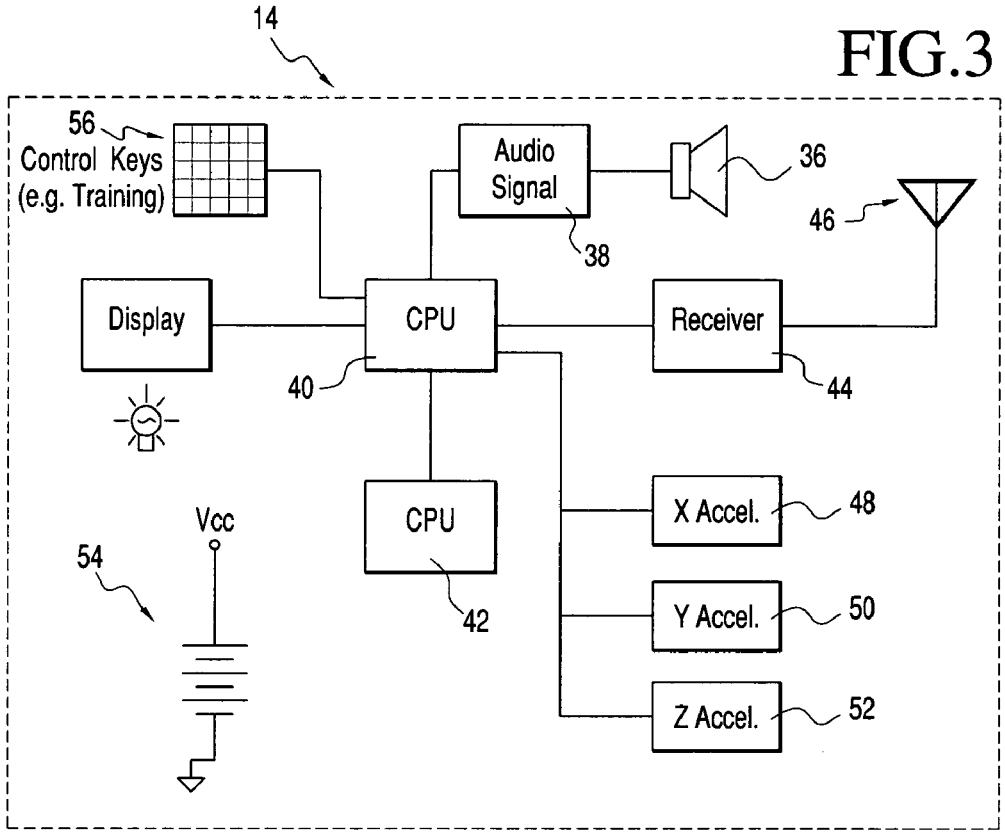
FIG. 3 is a diagram illustrating one embodiment of a finder for use in the locator system of FIG. 1, in accordance with the present invention.

Finder or receiver/processor 14, as shown in FIGS. 1 and 3, is housed in a rugged waterproof portable shell 30 preferably including a depending hand grip 32. At least one lighted display 34 is provided, along with an audio signal transducer 36 driven by an audio signal generator 38. Optionally, audio transducer 36 is included in a user-wearable headset 31. Preferably, a microprocessor 40 is programmed with instructions stored in a memory 42 and is connected to and controls a receiver 44 adapted to receive signals from an antenna 46. An array of accelerometers 48, 50, 52 is configured to sense motion of finder 14 and the accelerometer signals are input to the microprocessor 40 for use in computing and plotting finder motion, velocity and acceleration in three dimensions, (e.g., in Cartesian coordinates X, Y and Z, with the origin at the beginning of the search process). The finder housing 30 also carries its own portable power supply, such as a battery 54 and at least one control key or control input 56 for use in actuating a "training mode" during which a tag 12 and a finder 14 are operated together to become "companions" wherein a selected tag 12 is actuated and a selected finder 14 senses the unique coded transmission on a selected frequency, and stores the tag's unique coded transmission and frequency information.

The transmitted signal of beacon tag 12 is diagrammed in FIG. 2 and comprises a sequence of pulse pairs. In an exemplary embodiment, a first pulse width 60 is 33.33 microseconds (μS), the ranging interval 62 between the first and second pulses in a pair is 33.33 μS and the second pulse width 64 is also 33.33 μS. The off-time between pulse pairs 66 is preferably selected to be in the range of approximately one millisecond (mS) to one minute, and is followed by a subsequent pulse pair having the same pulse widths and ranging interval as in the preceding pulse pair.

The transmitted pulse pairs are modulated using frequency modulation of a carrier, phase modulation, amplitude modulation, or a combination of these modulation methods to generate a transmitted pseudo-random sequence which, when demodulated in the finder receiver 44 via (autocorrelation or cross correlation), generates a very narrow demodulated pulse that can be measured in time with great precision. The tag pulse pairs are repeated at a selected pulse pair repetition frequency (PRF) to permit detection of a relative tag-to-finder radius change (e.g., as when detecting Doppler shift). For the 33.33 μS pulse width described above, the symbol rate is preferable 300 MegaHertz (MHz) and the sequence length is preferably ten kiloBaud.

The finder 14, detects the tag's transmitted signal and begins a search while being carried into a search area by a user. As the user moves, the finder accelerometers 48-52, sense the movement and provide data to the finder CPU 40, which is programmed to calculate and plot the user's movements from an arbitrary origin defined as the place where the search began (e.g., a doorway). Finder 14 fine tunes its perceived stationary ranging interval 62 when the user is standing still, and then can detect a contraction in perceived ranging interval 62 whenever the user moves to bring the finder 14 closer to the tag 12, thereby sensing a diminishing relative radius change. Conversely, finder 14 detects an elongation or stretching in perceived ranging interval 62 whenever the user moves to bring the finder 14 farther away from tag 12, thereby sensing a growing relative radius change.

Finder 14 uses this relative radius change detection to determine whether (1) the user's search path is bringing the finder 14 closer to the tag 12 (which is attached to a sought-after individual or article), (2) the user's search path is taking the finder farther from the tag, or (3) the user's search path is not appreciably changing the relative radius between the finder 14 and the tag 12.

The user is provided with an easily interpreted form of audible feedback through finder audio transducer 36 in real time, when moving during a search, because the finder is programmed to generate a first, agreeable audio signal whenever it is determined that the user's search path is bringing the finder 14 closer to the tag 12. Conversely, finder 14 is programmed to generate a second, more urgent or strident audio signal whenever it is determined that the user's search path is taking the finder 14 farther from the tag 12.

The finder is also programmed to provide a visual indication on the finder display 34 of the plotted path taken from the origin and the estimated direction of the sought after beacon tag 12.

Another embodiment of the system and method in accordance with the present invention is illustrated in FIGS. 5, 6, 7 and 8, showing exemplary circuits for detecting signals transmitted from a beacon tag (e.g., 12) to a finder or receiver/processor having first and second receiver strings 62, 82.

Figure 5:
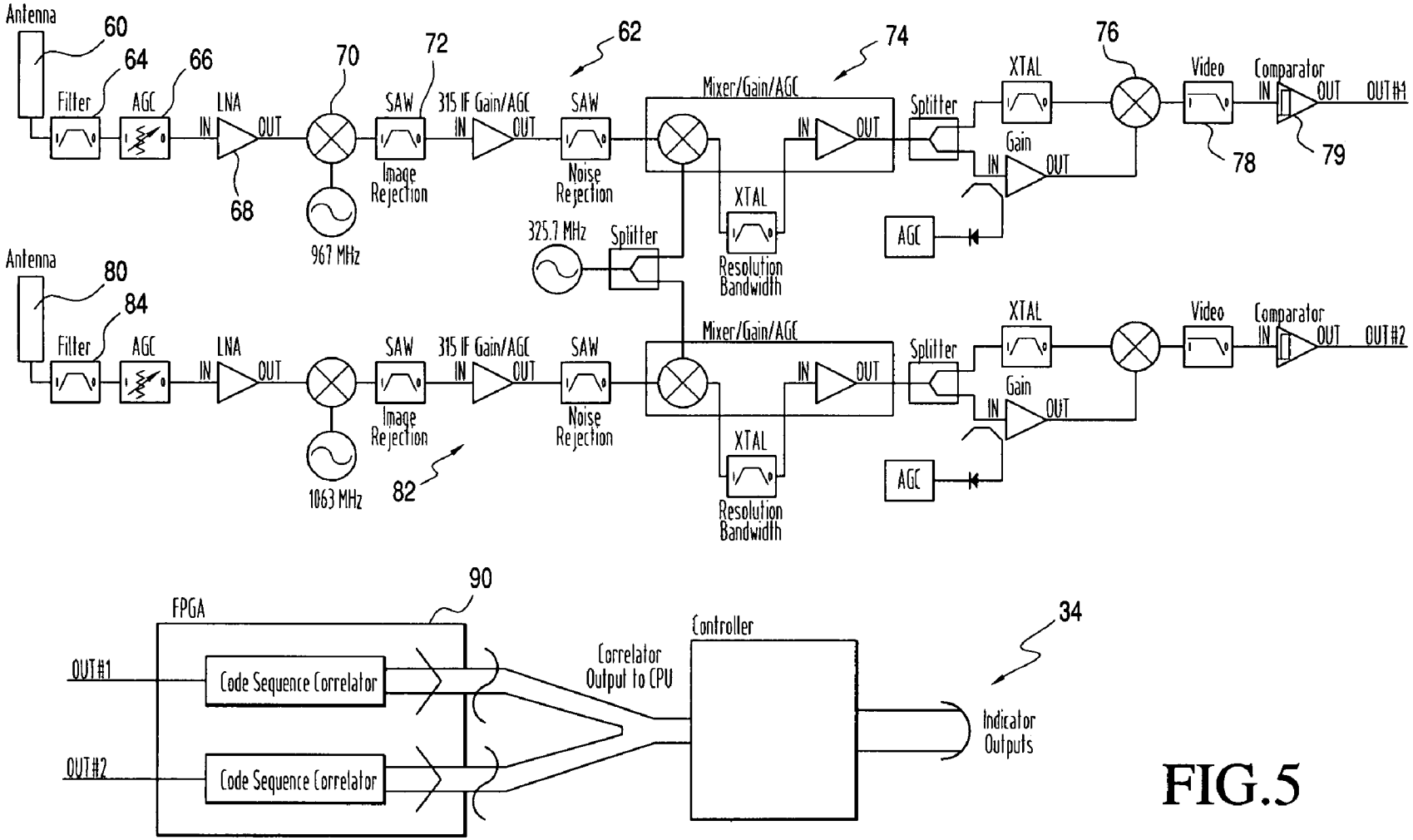
FIG. 5 is a block diagram of a second embodiment of the system of the present invention.
Figure 6:
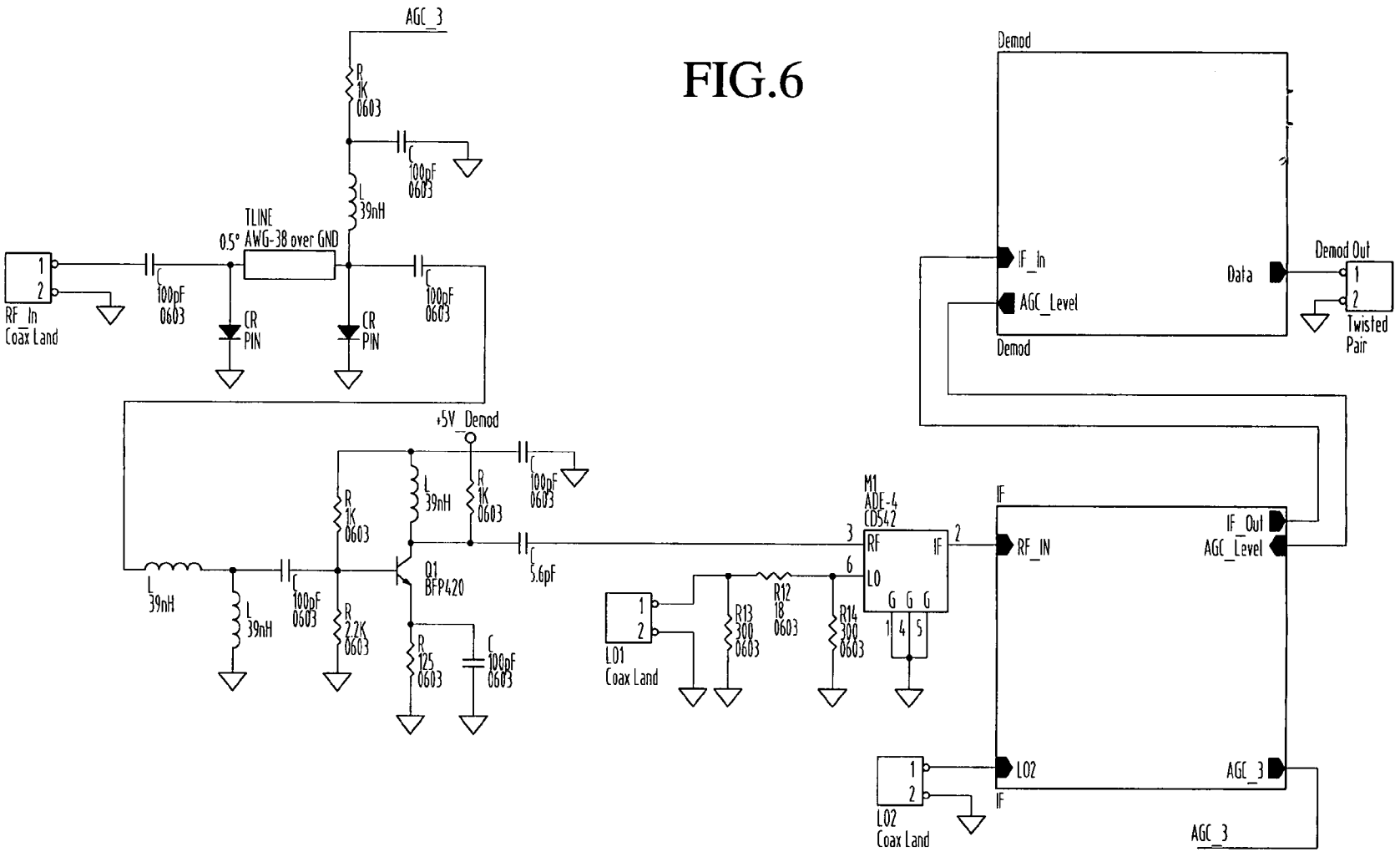
FIGS. 6, 7 and 8 are schematic circuit diagrams illustrating the circuits included in the system of the block diagram of FIG. 5.
Figure 7:
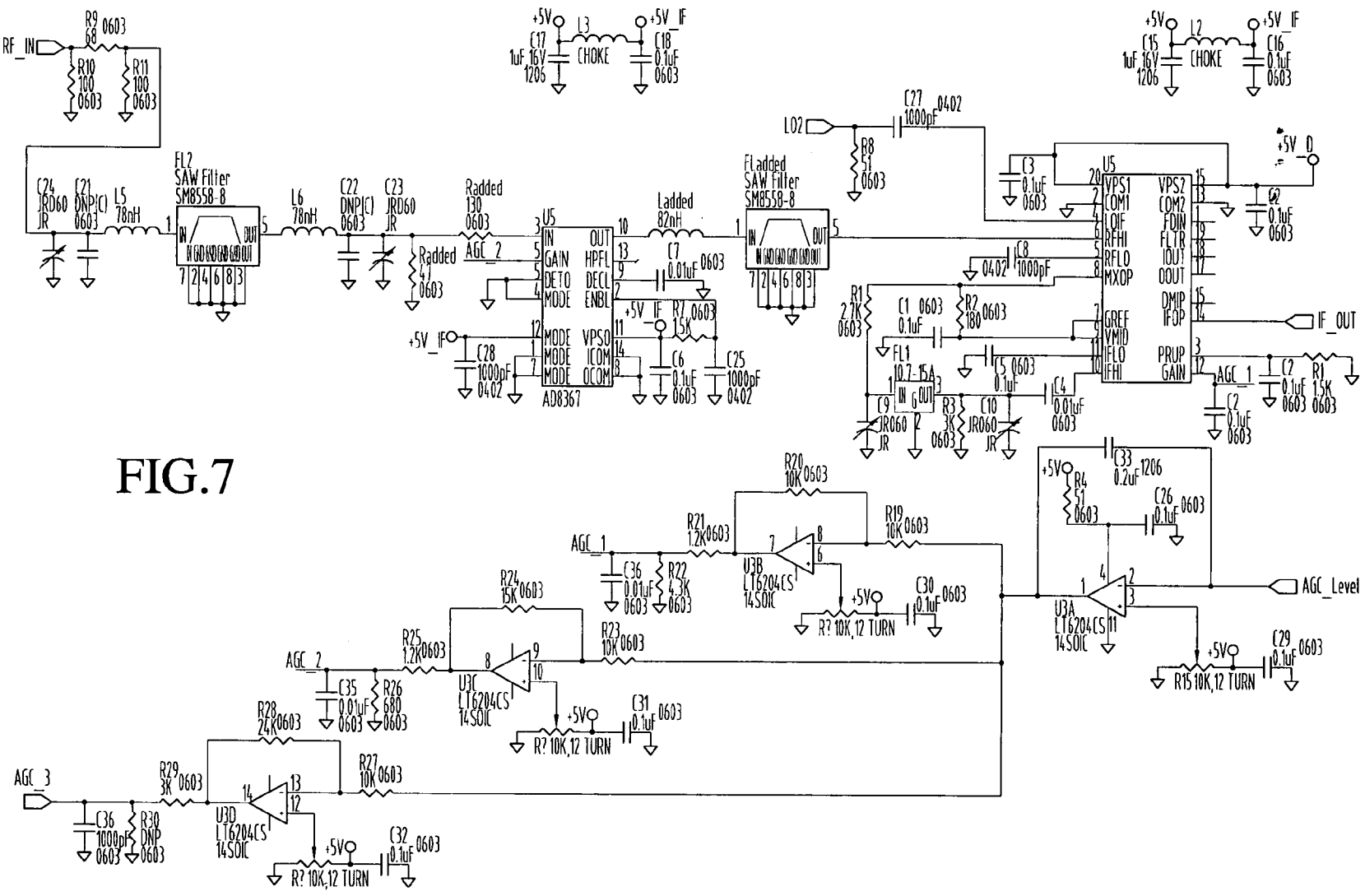
Figure 8:
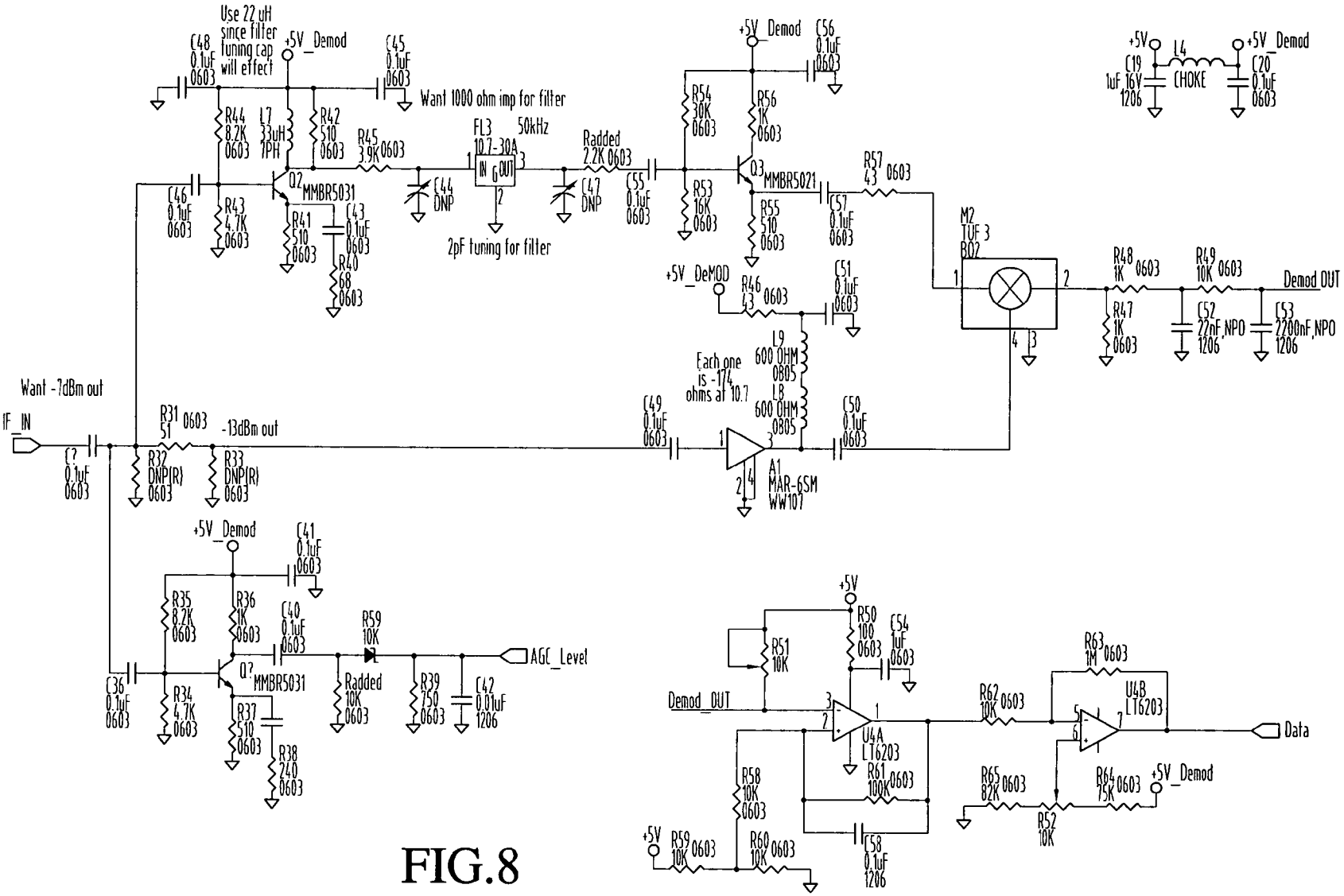

Referring now to FIG. 5, a second embodiment of the system of the present invention includes a first receiver string 62 generating a first receiver string output signal and a second receiver string 82 generating a second receiver string output signal. FIGS. 6-8 are schematics illustrating details of the circuits included in the system block diagram of FIG. 5.

There are two parallel channels involved in the block diagram of FIG. 5. The two parallel channels receive signals at two independent frequencies to provide two independent receive strings to bring in transmitted signals and turn them into data. Each receive string includes an FM (or phase modulated) type of Intermediate Frequency section (IF) controlled using a plurality of Automatic Gain Control (AGC) sections as part of the IF—this contrasts with the conventional limiting IF string often used for FM in the prior art.

Referring to FIG. 5 and beginning with antenna 60 on the left in upper string 62, the antenna feeds into a band pass filter 64—called a pre-selector or a cover filter—whose purpose is to exclude frequencies that are not of interest from that point on. The preselector band pass filter 64, in the exemplary implementation, has a bandwidth on the order of 10 MHz wide. The first receive string 62 and second receive string 82 (or first and second channels) shown in FIG. 5 are centered at approximately 650 and 750 MHz, respectively, and each preselector filter (i.e., 64 and 84) is about 10 MHz wide at their respective frequencies.

Coming out of the preselector filter, a filtered signal is input to a first AGC-controlled variable gain stage 66. AGC-controlled gain stages are distributed through the IF for the purpose of avoiding any given amplifier or mixer component from reaching a limiting condition. The signal is preferably not clipped anywhere in the IF, but as the signal grows in amplitude, amplifiers near the antenna will eventually clip if there's no variable attenuation preceding them. A variable stage is implemented before the first gain-producing element or the first semi-conductor element 68. So the elements passing the received signal include the antenna 60, passive filter 64, then a gain-control stage 66, then a low-noise amplifier (LNA) 68 provides the first gain the signal sees. After low-noise amplifier 68, the signal hits a first mixer 70, and the two L.O. frequencies are chosen, in this case, to be 315 MHz above the intended receive frequencies. Thus, 967 and 1063 MHz bring down the (approximately) 650 and (approximately) 750 MHz signals to a 15 MHz center frequency, which is the first IF. Coming out of that mixer, the signal then goes into another filter 72, centered at 315 MHz, then the signal encounters another amplifier stage 74 also with an AGC function included at that amplifier stage, at 315 MHz. The signal then passes through a narrower soft filter to band-pass down to less than 1 MHz of bandwidth. Prior to the second conversion, right after that second filter at 315, another conversion to 10.7 MHz is accomplished with a common local oscillator at 325.7 MHz, bringing each of the independent 315 MHz IFs down to 10.7 MHz. At 10.7 MHz, the signal is input to a crystal filter, very narrow, on the order of 15 kHz in bandwidth, 10.7 MHz center frequency, followed by yet another variable gain AGC amplifier stage 74. At this point, enough gain is available to consider demodulating the 10.7 MHz signal.

Coming out of that last variable gain stage 74, the signal is passed into a signal splitter that follows two paths. The signal comes out of the 10.7 MHz IF, splits into two paths, one path passes into an amplifier—and just at the input of that amplifier, a sample of the 10.7 MHz signal is picked off for use to generate a feedback control signal for the automatic gain (AGC) function. It's at that point where a signal amplitude reference is established for the automatic gain control function. Then, in the other side of the two paths generated from the splitter at 10.7 MHz, the signal goes through yet another crystal bandpass filter and from that crystal filter into one of the two input ports of a mixer 76. The other input port of the mixer is fed by the amplifier that comes from the other side of the splitter, which is then sampled or sniffed for the AGC amplitude reference, then passed through an amplifier, then the output of that amplifier is input to the second port of the third mixer, and it's within that third mixer 76 that the detection process actually occurs. Two versions of the 10.7 MHz signal are mixed together in the third mixer-producing a base band, or DC component, which is the demodulated video signal, soon to be converted into data, and other various frequency functions, like the double of 10.7 MHz signal , which is filtered off in a low pass video filter 78 on the output port of the mixer. Out of that video filter comes just the low frequency content, the signal in this case.

A digital signal is recovered from the demodulator, coming through that video filter and the digital signal is about a 5 kilo baud signal—5,000 bits per second. The signal comes out of the video filter and in to a comparator 79 that will set the size of that digital signal up to standard data levels, generating (for the first and second receive strings, respectively) what are called "Out[put] 1" and "Out[put] 2." Output 1 and Output 2 are at standard logic voltage levels and are fed into a single large gate array chip (FPGA) 90 programmed to perform a correlator function.

The beacon transmitter (e.g., from beacon tag 12) that supplied the original signals received at the inputs of antennas 60, 80 in the block diagram of FIG. 5 is designed to transmit a particular coded data sequence (e.g., as shown in FIG. 2), and the FPGA correlator has that data sequence also represented or stored within it. The correlator 90 receives the Out 1 and Out 2 signal data coming out of the demodulated IF to detect that coded sequence. When the stored sequence is detected the correlator generates an output signal that is proportional to the degree to which the correlator believes the contents of the correlator (at any moment in time) represent the code sequence. Therefore, if random noise was flowing through the correlator, the output of the correlator would be a multi-bit word (e.g., a ten bit word), whose value would be a mid-range value. If the maximum indicated value by ten bits is 1023, and the minimum value is 0 and if pure noise is fed into the correlator, then the output will be somewhere around 511 to 512. With a signal providing perfect correlation, the correlator generates an output of 1023—all ones—and if the correlator is fed a signal representing perfect anti-correlation, the correlator generates all zeros.

The ten bit correlator output stream is fed from each channel's correlator (that's a correlator processing Output 1 and a separate correlator processing Output 2, as shown in FIG. 5) having been received and processed from the two different receiving frequencies—and both of those outputs then go into a controller, microprocessor or CPU programmed to constantly monitor the correlator outputs for any output that is over a pre-set digital threshold. For example, if the output corresponding to noise is 511 to 512, a threshold may optionally be set at about 600. Expressing the program in plain English "anything over 600, trending up, or on its way to a perfect correlation of 1023, should be considered a worthwhile correlation"—means that for a correlation of sufficient quality to be observed as a workable signal, the controller is programmed to generate an indicator signal in response.

The correlator interpretation method or program takes into account the fact that while the signal received may be the sought after or intended signal, the signal may be so low in amplitude that it has added noise and so is not perfectly received—some bits are going to always be corrupted, so even if the intended signal is received, it won't generate a correlator output score of 1023, but will score something less. So, the threshold is set at a point (e.g., 600) where the noise outputs—although they bobble around and can cause all sorts of random values—rarely cross the threshold, but a sought after signal—that is, the intended signal, contaminated with noise—will usually cross the threshold. So, the CPU is programmed to make that decision, and in response the CPU generates an output to the user in the form of indicators—in this case it could be by generating an indicator output signal to activate one or more lights or an audio indication (e.g., a beeper) that annunciates or indicates that the sought after signal has been received.

This particular embodiment of the system also makes use of the anti-correlation (or reverse binary code sequence, e.g., a code sequence of 1010 . . . has an anti-correlation sequence of 0101 . . . ). In accordance with the method of the invention, the design code sequence is sent for a first condition, and when a second condition occurs, that code sequence is inverted to produce the anti-code sequence, or the all zero correlator output. In the exemplary embodiment, the primary code sequence is called the keep-alive or the proximity tone. The proximity tone indicates that "I see this transmitter, and he's okay." And the anti code sequence says "I see this transmitter, and he's activated the alarm condition"—meaning an alarm button has been pressed by the wearer of the transmitter or beacon tag. So the system can indicate two positive things—"I see that transmitter and we're not alarming" or "I see the transmitter and we are alarming" and the third condition is "I don't see the transmitter"—I see only noise, as defined by my thresholds. The anti code sequence threshold would be below 511 to 512, preferably set somewhere down around 430, and anything that's 430 and below (and that could be arbitrarily selected or set to another suitable number) would then be considered a successful receipt of the anti-code sequence indicating the alarm condition.

The correllators identify only the code signal from a unique beacon, where the code sequence is modulated onto the beacon's transmitted signal. The correllator is preporgorammed with the matching code for that unique beacon. Multiple systems can be used simultaneously since each beacon tag transmits a uniquely coded signal and each corresponding finder is preprogrammed with its matching beacon tag, allowing many search and recovery operations to take place in a given location simultaneously.

In the context of the system described above, if the monitored person were wearing a beacon tag 12 and had not yet pressed the panic button or alarm button, then the beacon tag would be continuously transmitting the code sequence, but after actuation of the beacon tag's alarm button or panic button, the anti code sequence is transmitted and the controller in the block diagram of FIG. 5 detects that as well.

Many things about this can be varied based upon the environment or intended application, including the bit rate of the code sequence. There are reasons to vary the bit rate. For secondary functions of actually doing the physical, three-dimensional locating of the beacon tag or emitter, the higher the bit rate sent, the more accuracy permitted in locating the beacon tag 12 in space. A very low code rate is handy for giving robust signal processing and a strong ability to receive the signal, but the numbers as described (i.e., the 5 kilo baud data rate) give a relatively weak ability to locate the signal in space. Accordingly, the embodiment illustrated in FIGS. 5-8 is not ideally well suited for the direction-finding part of the invention, but could be readily modified to accommodate a beacon pad 12 that transmits code sequence pairs that are used to generate pulse pairs in the correllators, where that pulse pair spacing allows the walking user/synthetic aperture direction-finding function to be added to the controller's programming.

FIGS. 6, 7 and 8 are the schematic details of the block diagram of FIG. 5. FIG. 6 corresponds to the part of FIG. 5 after antenna 60, and after the first filter 64. The starting point where the two diodes are seen on either side of a transmission line structure labeled "TLINE" is the AGC stage (e.g., 66).

At the output of the TLINE structure, a 39 nH inductor is in series with a 1K ohm resistor and on top of that a node labeled "AGC 3" is shown. AGC 3 is one of the various AGC drive voltages that operate various attenuator stages through the IF, it being the most advanced one in that it operates when the signal is largest. Then, coming out of that attenuator, at the transistor labeled "Q1"—the FP420—that transistor is the first low noise amplifier from the block diagram. The next block shown, labeled "M1", is the first mixer (e.g., 70). The LO source is a synthesizer—running off a shared frequency reference and it appears in the path here, an attenuator going into the LO port of the mixer labeled "M1." The next schematic is FIG. 7, entitled "Panic RF-RX Channel IF."

At that point the signal has exited the first mixer, "RF IN" at the upper left in the schematic of FIG. 7, the first thing the signal encounters there is the first of two SAW filters (e.g., 72 or 82 in the block diagram of FIG. 5). The SAW filter then feeds into an integrated circuit labeled "U5", a variable gain integrated amplifier. Coming out of U5 and through a second SAW filter, the signal passes into an IF chip (e.g., 74) comprising, internal to that IF chip, both the second mixer (to down convert to 10.7 MHz) and the IF gain string for the 10.7 MHz IF. The IF chip is labeled on this diagram "U1AD607." Coming out of the IF chip, the internal mixer in the chip is used, entering into what it called on the chip diagram "RF High." The local oscillator is shown going into that chip also as "LO2," making its entrance at the top, right of center of the page, and again appearing, and that signal goes in to pin 4 to be internally down-converted to 10.7 MHz. The chip is attached to a crystal filter, "FL1," diagrammed here as a 15 kHz—10.7-15A, a 15 kHz bandwidth crystal filter. The IF chip also accepts an AGC input . . . "AGC1," at a gain pin in the lower right-hand corner of chip, pin 12, provides an AGC feed. The IF chip generates something called "IFOUT," and IFOUT is going to the last page of the schematics, FIG. 8, the demodulator, and also to the AGC detector function.

In the schematic of FIG. 8, labeled "DEMOD," the IF that came out of the IF chip appears, and as shown here, is seen to go to three modular segments of circuitry. This is the splitting function, and the block diagram of FIG. 5 shows the signal splitting only two ways. The third path is the AGC signal sampling (or "sniff") path, in the bottom left-hand hand corner of that schematic, as driven by a transistor labeled MMBR5031. The AGC sniff path is getting a sample or sniff of the splitter output at that point, and the sampled signal is rectified with a Shotky diode, shown as "CR2," and that generates the AGC level, a DC signal level proportional to the signal size.

Returning now to the schematic of FIG. 7 (the IF) and to the cascade of op-amps, the AGC level appears on the node labeled AGC 3. The other input to that cascade of op-amps is a potentiometer, strung between 5 volts and ground, providing a reference level to which the AGC will set the IF signal level, as detected by that Shotky diode. The output of that op amp then drives the three additional op amps, each one generating a separate AGC voltage (AGC1, AGC2, and AGC3) going to one of the three separate gain control points in the IF, that being the two integrated amplifiers on this same page, and that pair of diodes after the antenna input. The potentiometer or trimmer goes to the inverting input of the op-amp and is used when performing a preliminary calibration as part of an alignment procedure.

Returning to FIG. 8, at the upper part of the schematic, the IF signal from the IF chip is monitored (i.e., see note "Want −7 DBM out.") This is where the IF level is monitored, and the trimmer or potentiometer is adjusted as the IF chip digests the AGC level. The AGC strategy for the "Want −7 DBM out," (at the IF out from that chip) is that no circuit element in the signal path should be permitted to clip or limit. At a signal level corresponding to −7 DBM, about 15 db of overhead is allowed, meaning that the anticipated clip level is about 15 db above −7 dbm, so the 10 db up level would be +3 dbm, and another 5 would be +8 dbm; at approximately +8 dbm , something in the string may begin to limit, so with about 15 db of overhead, the probability of limiting is minimized, and so by setting that point at −7 dbm, an adequate margin for safety is provided to avoid clipping.

The signal is then split two different ways, taking in one path—right through the middle of the page—if the signal is attenuated down, that appears to be about 6 db, and amplifier, "A1," is a buffer and a level-setting stage into the LO port of the detecting mixer (M2, in FIG. 8). The other side of that splitter path goes through a gain stage (i.e., a discreet transistor labeled "Q2 MMBR5031") and then through another crystal filter (slightly different in bandwidth than the previous crystal filter—the previous one was 10.7-15, this is 10.7-30, which is preferably a 50 MHz wide filter, despite the "−30.") The signal then passes through a second transistor Q3 and into the IF port of the mixer. These two paths are co-mingled at that point in the mixer M2 (e.g., 76) to produce the analog/digital signal out. The analog signal is a pre-level-shifted or pre-logic level regenerated digital signal—or the digital video, labeled "DMOD OUT" following a video filter (e.g., 78).

After the demodulating mixer labeled "M2," on the schematic page labeled "PANIC RX RX Channel DEMOD" or FIG. 8 In mixer M2, two signals are commingled from two versions of the 10.7 IF to produce a digital video signal which is passed into an RC video filter, rejecting both the 10.7 signals and higher harmonics, and mixing products, and taking the base band digital signal and into two limiting amplifiers on the bottom of FIG. 8, to threshold that signal—a resistor dividing network sets the thresholding levels. The thresholded signal is reconstructed in the form of a comparator function (e.g., 79) to generate logic level data from the digital video signal, leaving FIG. 8 with a symbol simply labeled "DATA." And at this point the demodulated, thresholded data signal enters the gate array 90 in the block diagram of FIG. 5. Each channel or receive string 62, 82 is processed in this way.

It is important that the received FM or ϕM signal not hard limit, or clip, at any amplifier stage, or any filter stage, in either of the receiver chains 62, 82, right up to the point of the demodulator. That requirement is to be contrasted with traditional FM receiver design. The problem comes up in any case where one is trying to process what's often called "code gain" from a signal that may be operating at very low signal-to-noise ratios. The classic example of this kind of processing is for Global Positioning System (GPS) signals. GPS generates signals that are received at an amplitude below the noise floor and are processed back up using code gain, and the system of the present invention operates using similar principles. When a received signal has a signal-to-noise that is negative—using conventional FM "hard limiting" type processes, the normal FM limiter IF demodulator exhibits a characteristic referred to as "quieting" and the biggest signal wins or controls the receiver. The limiter is designed to have so much gain that any signal that appears on its input, or just its own noise will cause some point in the limiter gain string to clip to a hard limit—to hit a voltage level beyond which a signal at the input continuing to move in the same direction no longer causes a proportional move in the output signal string. This limiting effect—the FM quieting effect—occurs because this biggest signal, this dominant signal, causes the limiter to generate a clipped output signal and so any smaller signals that might have been riding on top of that big signal are not represented in the output because the big signal (noise) has captured the limiter. Thus, for a particular period of time, until that particular gain stage comes back out of limiting, the only thing that comes out of the output of that limiter amplifier is one voltage level, and it doesn't vary with a change in the input. So the little signal riding on top of this larger signal is completely switched off. The big signal, however, if imagined as a sine wave clipped top and bottom, although distorted by the clipping, is fully represented and its frequency is readily visible. And since FM is a frequency detection system, the big signal's information is not compromised or lost. But the little signal riding on top of the big signal, for the period of time when the big signal is forcing the limiter into the hard sides of its operation, is completely lost, and that results in a relative suppression of the little signal's energy if viewing the spectrum of the output. And that's called the capture effect, or the quieting effect of an FM limiter string.

In the system and method of the present invention, the big signal is likely to be noise. And the sought after signal, a little buzz riding on top of the noise, is the desired beacon tag's signal. So if a noise signal were allowed to clip in a limiter situation, it would suppress the intended signal. For the purposes of implementing any demodulator, a predictable level must be set so the demodulator can operate, and the level is adjusted in a linear way to avoid clipping, so that as the noise amplitude changes, the small signal riding on top of the noise is always there, and when the signal is re-processed, in the demodulator and in the correlator that follows, that little signal is there to be found—given that it can be pulled out of the noise. But if the noise dominates the intended signal, as is a conventional FM limiter string, the signal would be lost, and recovering the intended signal would be impossible and the code sequence correlators would have nothing to work with, leaving essentially nothing for the controller 40 to process.

The correlators 90 would still operate if the signal to noise ratio were large enough, but the benefit of doing linear AGC controlled reception is that very small signals that are below the noise floor can be processed.

In an alternative embodiment, the three accelerometers 48, 50, 52 are supplemented with, preferably, first and second solid state ring laser gyroscopes (not shown) configured within receiver/processor 14 in orthogonal directions. The combination of accelerometers and gyroscopes permits detection of tumbling or non-translational rotation of the receiver/processor housing or shell 30. In this embodiment, the first and second gyroscopes provide If the user grasps receiver/processor housing 30 by its pistol grip or projecting handle 32 when in use, however, there will be virtually no tumbling or non-translational rotation of receiver/processor housing 30, and so the gyroscopes can be omitted.

Having described preferred embodiments of a new and improved locator system and method, it is believed that other modifications, variations and changes will be suggested to those skilled in the wireless communications art in view of the teachings set forth herein. It is therefore to be understood that all such variations, modifications and changes are believed to fall within the scope of the present invention as defined by the appended claims.

What is claimed is:

1. A method for locating an individual or article in a three dimensional space, comprising the steps of:

(a) providing a transportable beacon carrying a transmitter connected to an antenna, a programmable device, a portable power source and a control input, all carried in or on a supporting structure, wherein said transportable beacon is programmed to transmit a unique coded pulse signal;

(b) providing a portable finder including a housing carrying a display, a programmable device, a receiver connected to an antenna, a portable power source, a control input, an audio signal generator connected to an audio transducer, and an accelerometer adapted to sense the motion of the finder, wherein the finder is programmed to receive and decode the unique coded pulse signal of said transportable beacon;

c) transmitting a precisely timed pair of code sequences from said transportable beacon, said precisely timed pair of code sequences being modulated to define an inter-pulse ranging interval;

(d) determining changes in the inter-pulse ranging interval for locating said individual or article.

2. A method for locating an individual or article of claim 1, further comprising the step of:

(d) receiving said transportable beacon's precisely timed pair of code sequences and, while said finder is stationary with respect to a relative radius to said transportable beacon, measuring said inter-pulse ranging interval.

3. A locator system permitting location of a person or article comprising:

a transportable beacon including an active transmission circuit for generating and radiating pulses of electromagnetic energy, said radiated pulses comprising an inter-pulse ranging interval, said beacon being readily attached to or carried by a person or article; and a transportable finder or receiver/processor adapted to receive said radiated pulses, generate a signal corresponding to said inter-pulse ranging interval, sense the relative position of the beacon and indicate changes in that relative position to a user when carrying the finder.

4. The locator system of claim 3, said beacon being configured to transmit a communication corresponding to activation of a beacon panic button;

said transportable receiver/processor being adapted to receive said communication from the beacon corresponding to activation of said "panic button" and, in response, indicates activation of said panic button to said user.

5. The locator system of claim 3, wherein said transportable receiver/processor is further adapted to determine a distance or range to said beacon.

6. The locator system of claim 3, wherein said transportable receiver/processor is further adapted to determine a relative direction to said beacon, and to indicate said relative direction to said user.

7. The locator system of claim 3, wherein said transportable receiver/processor is further adapted to detect the presence of said beacon, and to indicate said presence to said user.

8. The locator system of claim 3, wherein said transportable receiver/processor is further adapted to plot change in relative position of said beacon, and to indicate "getting closer" and "going farther away" to said user, while said user moves about with said receiver/processor.

9. A method for locating an individual or article in a three dimensional space, comprising the steps of:

(a) providing a transportable beacon carrying a transmitter connected to an antenna, a programmable device, a portable power source and a control input, all carried in or on a supporting structure, wherein the beacon is programmed to transmit a unique coded pulse signal comprising a precisely timed pair of code sequences;

(b) providing a portable finder including a housing carrying a display, a programmable device, a receiver connected to an antenna, a portable power source, a control input, an audio signal generator connected to an audio transducer, and an accelerometer adapted to sense motion of the finder, wherein the finder is programmed to receive and decode the unique coded pulse signal of said beacon;

c) transmitting a precisely timed pair of code sequences from said beacon, said precisely timed pair of code sequences being modulated to define an inter-pulse ranging interval;

(d) receiving said beacon precisely timed pair of code sequences and measuring said inter-pulse ranging interval; and (e) plotting change in relative position of said beacon, and indicating "getting closer" and "going farther away" based on said measured inter-pulse ranging interval, while said user moves about with said finder.

10. The method for locating an individual or article in a three dimensional space of claim 1, wherein step (c) comprises:

(c1) transmitting a first code sequence from said beacon, said first code sequence comprising a sequence of pulse pairs, wherein a first pulse of the pulse pair has a selected pulse width, said second pulse of the pulse pair has a selected pulse width, and said first pulse is separated from said second pulse in said pulse pair by a selected ranging interval;

(c2) transmitting a second code sequence from said beacon, said second code sequence comprising a sequence of pulse pairs wherein a first pulse of the pulse pair has a selected pulse width, said second pulse of the pulse pair has a selected pulse width, and said first pulse is separated from said second pulse in said pulse pair by a selected ranging interval;

(c3) modulating said first code sequence and said second code sequence onto a carrier to generate a pseudo-random sequence which, when demodulated in said finder, generates a very narrow demodulated pulse that can be measured in time with great precision.

11. The method for locating an individual or article in a three dimensional space of claim 10, further comprising the step of:

(d) receiving, in said finder, said beacon's transmission including said precisely timed pair of code sequences.

12. The method for locating an individual or article in a three dimensional space of claim 11, further comprising the step of:

(e) indicating to the user of the finder, that the beacon's signal has been detected.

13. The method for locating an individual or article in a three dimensional space of claim 11, further comprising the step of:

(e) demodulating said beacon's transmission and generating a very narrow demodulated pulse that can be measured in time with great precision.

14. The method for locating an individual or article in a three dimensional space of claim 13, further comprising the step of:

(f) measuring said inter-pulse ranging interval.

15. The method for locating an individual or article in a three dimensional space of claim 14, further comprising the step of:

(g) identifying a change in relative position of said beacon with regard to said finder.

16. The method for locating an individual or article in a three dimensional space of claim 15, further comprising the step of:

(h) indicating at least one of "getting closer" and "going farther away", while said user moves about with said finder.

17. The method for locating an individual or article in a three dimensional space of claim 10, wherein step (c1) further comprises transmitting a first code sequence from said beacon, said first code sequence comprising a sequence of pulse pairs, wherein a first pulse of the pulse pair has a selected first pulse width, said second pulse of the pulse pair has said selected first pulse width, and said first pulse is separated from said second pulse in said pulse pair by a selected ranging interval.

18. The method for locating an individual or article in a three dimensional space of claim 17, wherein said transmitted pulse pairs are repeated at a selected pulse pair repetition frequency to permit detection of a relative beacon-to-finder radius change by detecting Doppler shift in the received signal.

19. The method for locating an individual or article in a three dimensional space of claim 17, wherein said selected first pulse width is approximately 33.33 micro-seconds and the code sequence length is approximately ten kilobaud.

20. The method for locating an individual or article in a three dimensional space of claim 1, further comprising the steps of:

(d) providing a panic button actuator in said beacon, said panic button actuator being configured to control transmission of a panic signal, said panic button being adapted for silent actuation by the user of the beacon;

(e) providing, in said finder, a panic indicator responsive to reception of said panic signal in said finder's receiver; and (f) actuating said finder's panic indicator when said finder's receiver receives said transmitted panic signal.

* * * * *